US010871352B2

(12) United States Patent
Kante et al.

(10) Patent No.: US 10,871,352 B2
(45) Date of Patent: Dec. 22, 2020

(54) METASURFACE DEVICE FOR CLOAKING AND RELATED APPLICATIONS

(71) Applicant: The Regents of the University of California, Oakland, CA (US)

(72) Inventors: Boubacar Kante, San Diego, CA (US); Li-Yi Hsu, San Diego, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 1088 days.

(21) Appl. No.: 14/999,913

(22) Filed: Oct. 31, 2016

(65) Prior Publication Data

US 2019/0170484 A1 Jun. 6, 2019

Related U.S. Application Data

(60) Provisional application No. 62/248,651, filed on Oct. 30, 2015.

(51) Int. Cl.

| | |
|---|---|
| ***G02B 7/00*** | (2006.01) |
| ***F41H 3/02*** | (2006.01) |
| *H01Q 17/00* | (2006.01) |

(52) U.S. Cl.

CPC ..... *F41H 3/02* (2013.01); *H01Q 17/005* (2013.01)

(58) Field of Classification Search

CPC ..... F41H 3/02; H01Q 17/005
USPC ..... 359/896
See application file for complete search history.

(56) References Cited

U.S. PATENT DOCUMENTS

2010/0225562 A1* 9/2010 Smith ..... B82Y 20/00 343/909

OTHER PUBLICATIONS

Invisibility Cloak Blurs Line Between Magic and Science (w/Video) (May 1, 2009) retrieved Oct. 28, 2016 from http://phys.org/news/2009-05-invisibility-cloak-blurs-line-magic (3 pages total).

"Miniature Invisibility 'Carpet Cloak' Hides More than Its Small Size Implies", New Release from The Optical Society on Apr. 19, retrieved Oct. 28, 2016 from http://www.osa.org/en-us/about_osa/newsroom/news_releases/2011/miniatureinvisibilitycarpetcloak/ (3 pages total).

(Continued)

*Primary Examiner* — Mark Hellner

(74) *Attorney, Agent, or Firm* — Stuart H. Mayer; Mayer & Williams PC

(57) ABSTRACT

Provided are systems and methods for cloaking an object on a ground plane. A thin dielectric metasurface is used to reshape the wavefronts distorted by the object in order to mimic the reflection pattern of a flat ground plane. To achieve such "carpet cloaking", the reflection angle is made equal to the incident angle everywhere on the object by providing a graded metasurface with a designed phase gradient. This provides additional phase to the wavefronts to compensate for the phase difference amongst lightpaths induced by the geometrical distortion. One exemplary metasurface is described which is designed for the microwave range using highly sub-wavelength dielectric resonators. The approach can be applied to hide any scatterer under a metasurface of class C1 (first derivative continuous) on a groundplane not only in the microwave regime, but also at other frequencies, including higher frequencies, up to the visible.

32 Claims, 11 Drawing Sheets
(10 of 11 Drawing Sheet(s) Filed in Color)

(56) References Cited

OTHER PUBLICATIONS

Zeeya Merali, "A cloaking device can shield macroscopic objects in visible light" Published online Dec. 15, 2010, Nature, doi:10.1038/news.2010.678, retrieved on Oct. 28, 2016 from http://www.nature.com/news/2010/101215/full/news.2010.678.html (3 pages total).
Nearly perfect, ultrathin invisibility cloak could have wide practical applications (Jan. 17, 2013) retrieved Oct. 28, 2016 from http://phys.org/news/2013-01-ultrathin-invisibility-cloak-wideapplications.html (3 pages total).
Daniel Strain, "Invisibility cloaks hit the big time" Science News, vol. 179 #5, Feb. 26, 2011, p. 12 retrieved Oct. 28, 2016 from https://www.sciencenews.org/article/invisibility-cloaks-hit-big-time (3 pages total).
"Ultra-Thin Unidirectional Carpet Cloak and Wavefront Reconstruction with Graded Metasurfaces" Wireless Networking & Communications Group, The University of Texas at Austin, Research Briefs, Feb. 4, 2015 retrieved on Oct. 28, 2016 from https://wncg.org/research/briefs/ultra-thin-unidirectional-carpet-cloak-and-wavefront-reconstruction-graded (1 page total).
Chris Gayomali, "A brief history of the real-life invisibility cloak" This Week—Mar. 27, 2013, retrieved on Oct. 28, 2016 from http://www.yahoo.com/news/brief-history-real-life-invisibility-cloak-122700549.html?ref=gs (12 pages total).
Boubacar Kanté, Dylan Germain, and Andréde Lustrac, "Experimental demonstration of a nonmagnetic metamaterial cloak at microwave frequencies", Phys. Rev. B 80, 201104(R) (2009) (4 pages total).

* cited by examiner

FIG. 1A
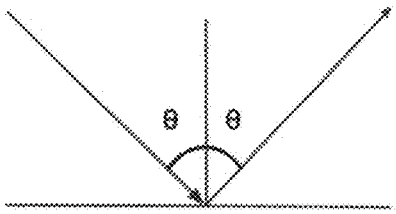
FIG. 1B
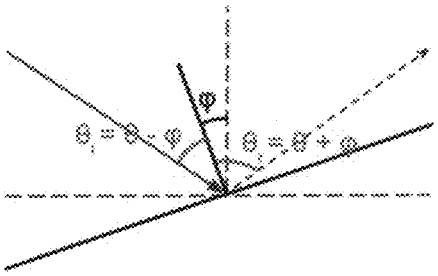
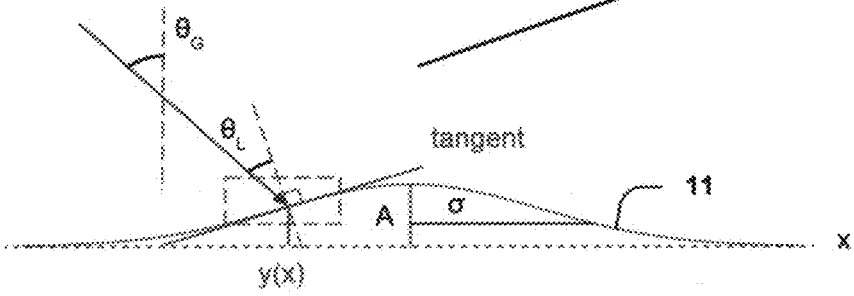
FIG. 1C

FIG. 3A
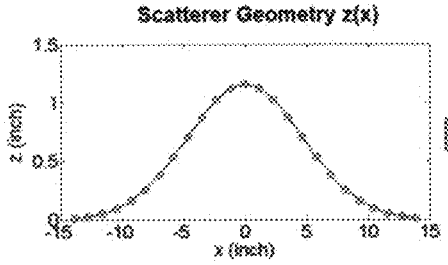
FIG. 3B
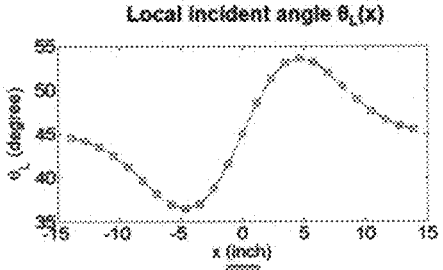
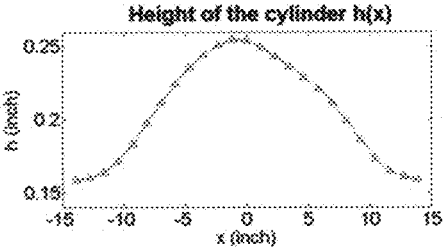
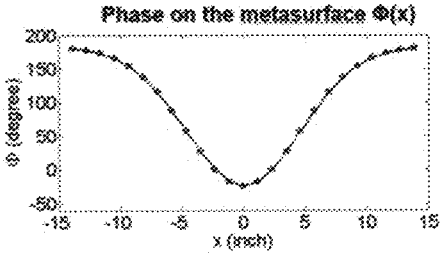
FIG. 3D
FIG. 3C

FIG. 5A
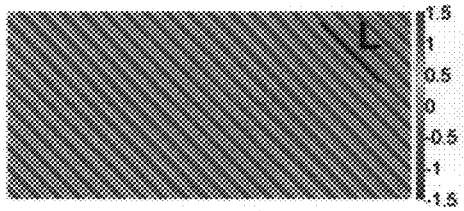
FIG. 5C
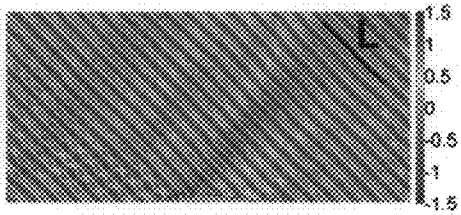
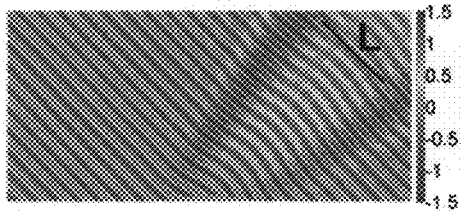
FIG. 5B
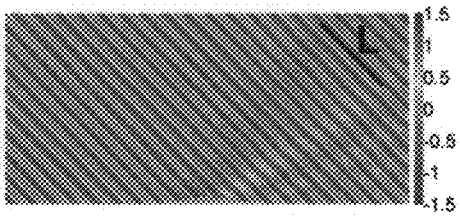
FIG. 5D

METASURFACE DEVICE FOR CLOAKING AND RELATED APPLICATIONS

CROSS-REFERENCE TO RELATED APPLICATIONS

This application claims benefit of priority of U.S. Provisional Patent Application Ser. No. 62/248,651, filed Oct. 30, 2015, entitled "Thin and Light Dielectric Metasurface Invisibility Cloaking Devices and Related Applications in Wave Focusing, Interior Design, and Art", which application is incorporated by reference herein in its entirety.

FIELD

The invention relates to cloaking devices.

BACKGROUND

Due to their ability to manipulate electromagnetic waves, metamaterials have been extensively studied in the past fifteen years. They have resulted in several novel concepts and promising applications, such as cloaking devices, concentrators, wormholes and hyper lenses.

Among all potential applications, invisibility cloaks have especially received considerable attention. Up to now, the main theoretical tool used for designing invisibility cloaks has been transformation optics/conformal mapping. According to Fermat's principle, an electromagnetic wave will travel between two points along the path of least time. In a homogeneous material, this path is just a straight line. However, in an inhomogeneous material, the path becomes a curve, because waves travel at different speeds at different points. Thus, one can control the path of waves by appropriately designing the material parameters (electric permittivity and magnetic permeability). In the case of cloaking, a metamaterial surrounding the target can be used to force light to bypass a region of space, effectively isolating it from incoming electromagnetic waves.

Using transformation optics, the first experimental demonstration of cloaking was achieved at microwave frequencies. However, transformation optics usually leads to highly anisotropic and inhomogeneous material parameters. In addition, extreme material parameter values, such as negative or near-zero values, are often required.

To obtain extreme values for the permeability, split-ring resonators (SRRs) with magnetic resonances have been used. Such resonances are strongly dispersive and result in cloaks working only in a narrow frequency range. Most metals are also highly "lossy" at optical frequencies, which prohibits a simple scaling of SRRs down to the nanoscale.

This Background is provided to introduce a brief context for the Summary and Detailed Description that follow. This Background is not intended to be an aid in determining the scope of the claimed subject matter nor be viewed as limiting the claimed subject matter to implementations that solve any or all of the disadvantages or problems presented above.

SUMMARY

Recently, a refinement of the transformation optics strategy was put forward. Termed 'hiding under the carpet', it works not by routing light around a given scatterer, i.e., object to be cloaked, but by transforming its reflection pattern into that of a flat plane. With a well-designed material, reflected waves appear to be coming from a flat plane and the scatterer thus becomes invisible.

A major drawback of current cloaking devices is that they are large in size. Metasurfaces or frequency selective surfaces, as opposed to metamaterials, have many advantages, including of taking up less physical space than metamaterials. However, a metasurf ace is not the same as the surface of a meta-material. Rather, a metasurface is a thin layer with a sub wavelength thickness (less than the wavelength of the incident light, and generally significantly less, e.g., 1/10 the wavelength). In this way, meta-materials may be made very light, flexible, and so on. Such materials may be particularly important due to the design afforded by generalized Snell's laws of reflection and refraction. In such surfaces, wave propagation can be controlled using a thin coating layer with a properly designed phase gradient over the surface. Many applications may be realized from metasurf aces, such as reflectarrays, flat lenses, and hologram-based flat optics. More recently, total cross-polarization control has also been demonstrated.

Systems and methods according to present principles employ metasurfaces as components in a "hiding under the carpet" device. In one implementation, a dielectric metasurface with a tailored phase gradient may be employed in "carpet cloaking". In more detail, a single extremely thin (e.g., $\lambda/10$ or $\lambda/12$) all-dielectric metasurface has been shown to be sufficient to accomplish invisibility, where $\lambda$ is the wavelength of expected incident light. For example, if it is desired to cloak objects from electromagnetic waves in the microwave spectrum, a metasurface may be employed that is thinner than the microwave wavelength, or even thinner, e.g., 1/10 or 1/12 the microwave wavelength expected. The dielectric surface may include, e.g., an array of elements such as cylinders arranged on a substrate. Other shapes may also be used, e.g., rectangular solids, cubes, and the like, so long as the dimensionality requirements as described below are met, e.g., that the size be appropriate for the incident light and that the dimensions be variable in a way to effectively provide or create a phase distribution to the incident light so that the reflected wave can be configured as desired to provide the desired cloaking effect. Once the object is covered with such a metasurface, observers cannot distinguish it from a flat surface.

By using an extremely thin dielectric metasurface, distorted wavefronts are reshaped to mimic the reflection pattern of a flat ground plane. To achieve this, the reflection angle should generally be equal to the incident angle everywhere (or at least in most locations, e.g., over 95%) on the object. To achieve this, the required phase gradient is calculated and employed to reconstruct in an appropriate way the phase of the reflected waves, and this determined phase gradient is used to design a metasurface as a cloaking device, in this way cloaking the object sitting on the ground plane from an incoming plane wave. The design works at least in part by providing wavefronts with a local additional phase to compensate for the phase difference induced by the geometrical distortion.

The metasurface may be designed to work at frequencies from microwaves to optics using low-loss, sub-wavelength dielectric resonators. The design has been verified by full-wave time-domain simulations.

In one aspect, the invention is directed towards a cloaking device for an object configured to cloak the object from incident electromagnetic waves having a wavelength or range of wavelengths, including: a metasurface, the metasurface having a thickness less than the wavelength of the incident light, the metasurface configured to provide a phase distribution to the incident electromagnetic waves such that the incident electromagnetic waves are reflected in such a way that the metasurface appears substantially flat.

Implementations of the invention may include one or more of the following. Themetasurface may be constructed such that a phase distribution results such that incident electromagnetic waves with frequencies between a microwave regime and a visible light regime are reflected in such a way that the metasurface appears flat. In particular, incident microwaves are reflected in such a way that the metasurface appears flat. Themetasurface may be configured to cover the object to be cloaked, the object having a shape expressed by z(x), and where the phase distribution provided by the metasurface is according to an equation below, where $k_0$ is an angular frequency of the incident electromagnetic wave, $\theta_G$ is a global incident angle expected, and const is chosen from a known phase of a flat ground plane:

$$\phi(x)=2k_0z(x)\cos\theta_G+\text{const}$$

The phase distribution may be such that the metasurface appears flat regardless of the shape of the object.

The constant above may be selected to correlate to a phase of a background that the metasurface is emulating.

Themetasurface may include a plurality of elements, each including a dielectric disposed on a substrate.

The elements may be cylinders, and a height of the cylinders may be employed to provide the phase distribution. The dielectric may be a ceramic including a high permittivity ceramic, e.g., one permittivity values ranging from about 10 to 1000. The ceramic may have a low loss tangent, e.g., ranging from about 0 to $10^{-2}$. The substrate may include a low refractive index material or a transparent material. One exemplary substrate is Teflon®. The substrate also may have a low loss tangent. A refractive index of themetasurface may be substantially continuously varied, and in the case of discrete cylinders, may be discreetly but substantially continuously varied. The phase distribution provided by the metasurface may be linear with respect to frequency and cosine-like with respect to global incident angle.

Themetasurface may be passive or may include one or a plurality of active elements. Formetasurface is with active elements, themetasurface may further include an incident wave angle sensor layer configured to provide a signal feedback to the plurality of active elements of the metasurface. Elements of the metasurface may then be configured to generate a phase distribution based on information about the incident wave angle received from the incident wave angle sensor layer.

The appearance of being substantially flat may in one implementation mean that variations in perceived flatness are no greater than a range of about a few fractions of a degree to a few degrees, e.g., 0.5 and 5°.

In another aspect, the invention is directed towards a method of cloaking an object including covering an object with the device as noted above.

In a further aspect, the invention is directed towards a method for designing a cloaking device for an object, including: receiving a shape of an object to be cloaked; and configuring a metasurface such that the metasurface provides a phase distribution configured such that electromagnetic rays incident on the metasurface are reflected in such a way that the metasurface appears flat.

Implementations of the invention may include one or more of the following. The configuring may include configuring the phase distribution to be linear with respect to frequency and cosine-like with respect to global incident angle. The shape of the object to be cloaked may be expressed by z(x), and the phase distribution may be configured to be according to the equation below, where $k_0$ is an angular frequency of the wave, $\theta_G$ is a global incident angle, and const is chosen from a known phase of a flat ground plane:

$$\phi(x)=2k_0z(x)\cos\theta_G+\text{const}$$

Advantages of the invention may include, in certain embodiments, one or more of the following. Systems and methods according to present principles in some implementations overcome a major drawback of metamaterial-based cloaking devices, i.e., that they are large in size and heavy, because a large space is needed to progressively bend light. In contrast, the cloaking devices according to present principles may constitute a single extremely thin surface that is smaller than 1/10 the wavelength of the incident wave and smaller than bulky cloaking systems by more than two orders of magnitude. Systems and methods according to present principles can advantageously employ ceramics, which are generally light and convenient to configure.

A drawback of prior systems is that they use metals that are lossy. Cloaks that are lossy reflect light at a lower intensity than what hits their surface, and lead to a sharp drop in brightness. This aspect leads to their being discerned, thus defeating the cloaking attempt. The cloaking devices according to present principles have the advantage of overcoming this fundamental drawback as well, as the same employ metasurfaces that are more compact, slimmer, less lossy, lighter, and potentially wearable. Such structures can also be made reconfigurable. The approach of systems and methods according to present principles is general and can be applied to hide any object on a ground plane using, e.g., a metasurface of class C1 (first derivative continuous). Moreover, this approach of bending electromagnetic waves with metasurf aces can be used not only for carpet cloaks but also for light focusing to make flat optics devices such as thin solar concentrators, quarter-wave plates, and spatial light modulators. Systems and methods according to present principles can also be used in interior design and art.

Other advantages will be understood from the description that follows, including the figures and claims.

This Summary is provided to introduce a selection of concepts in a simplified form. The concepts are further described in the Detailed Description section. Elements or steps other than those described in this Summary are possible, and no element or step is necessarily required. This Summary is not intended to identify key features or essential features of the claimed subject matter, nor is it intended for use as an aid in determining the scope of the claimed subject matter. The claimed subject matter is not limited to implementations that solve any or all disadvantages noted in any part of this disclosure.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIGS. 1(A)-1(C) illustrate: (A) reflection from a flat plane, (B) reflection from a flat plane with a counterclockwise rotation by an angle $\phi$, and (C) reflection from an object, here modeled as a scatterer having a Gaussian shape.

FIGS. 3(A)-3(D) illustrate flow of a graded metasurface design according to present principles. FIG. 3(A) shows the scattered geometry versus position x, FIG. 3(B) shows the local incident angle $\theta_L$ versus position x, FIG. 3(C) shows the phase shift versus position x, and FIG. 3(D) shows the height of the cylinder versus position x.

FIGS. 5(A)-5(D) shows a computer model simulation showing stages of development, e.g., FIG. 5(A) shows a ground plane, FIG. 5(B) shows a Gaussian-shaped object, FIG. 5(C) shows the Gaussian-shaped object covered by a cloaking metasurface comprised of a plurality of discrete cylinder elements, and FIG. 5(D) shows a metasurface using a more continuously-varying refractive index satisfying the phase gradient.

Like reference numerals refer to like elements throughout. Elements are not necessarily to scale unless otherwise noted.

DETAILED DESCRIPTION

Figure 2:
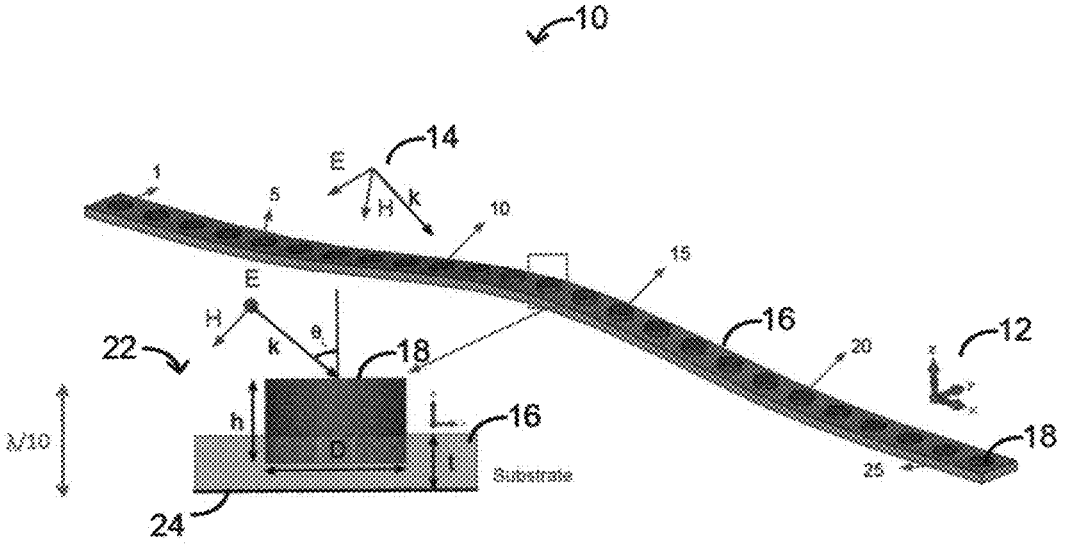
FIG. 2 is a schematic depiction of a metasurface, discretized with 25 cylinders, with an inset showing a unit cell of the metasurface, according to present principles. The system is shown along with a coordinate system.

To achieve carpet cloaking of an object, i.e., mimicking the reflection pattern of a flat ground plane, the reflection angle has to be equal to the incident angle everywhere on the object, or for that matter on the metasurface providing the cloaking. In this way, an observer will just see a flat ground plane and the object will be invisible and thus effectively cloaked.

A metasurface may be generally designed for a particular wavelength of incident electromagnetic waves, or range of wavelengths. For example, to cloak an object from radar waves, microwaves would be employed, and the sizes of the elements forming the metasurface described below, e.g., cylinders, would be sized accordingly, e.g., 1/10 the wavelength of the incident light (as used in the simulation designed below). To cloak an object from optical waves, much smaller elements would be used as part of the metasurface.

In more detail, and referring to FIG. 1(C), an object 11 is shown that is described by a surface z(x, y). This surface is invariant in y and is described by a Gaussian function, i.e., the object has a Gaussian shape in profile:

$$z(x) = A\,e^{\frac{-x^2}{\sigma^2}} \tag{1}$$

where σ indicates the standard deviation of the Gaussian curve and provides a measure of its width.

To illustrate a cloaking mechanism, two cases are considered. In FIG. 1(A), an incident wave is reflected by a flat ground plane. Snell's law dictates that the reflection angle is equal to the incident angle (θr=θi). In FIG. 1(B), when the flat ground plane is rotated counterclockwise by an angle ϕ), the new incident angle becomes $\theta_i-\phi$ while the new reflection angle becomes $\theta_r+\phi$). Approximating each point of the Gaussian object surface locally by a flat plane, the cloak can be designed based on the geometric considerations made in FIGS. 1(A)-1(B), which are both governed by Snell's law.

FIG. 1(C) illustrates reflection from a Gaussian object surface 11, and shows that reflections from the same can be treated locally, at each point along the surface, as a flat plane. It will be understood that in the most general case, any general surface can be treated, and/or any general surface can be approximated at a local area level by a smooth curve scattering object such as a Gaussian scattering surface or the like.

To control the reflection angle, the generalized Snell's law of reflection is used:

$$\sin(\theta_r) - \sin(\theta_i) = \frac{1}{k_i}\frac{d\Phi(x)}{dx} \tag{2}$$

$k_i$ Is the wave vector in the incident medium and ϕ(x) is the phase distribution. From Eq. (2), it can be seen that the reflection angle is entirely controlled by the phase gradient. Various phase gradients can be achieved with a graded metasurface. For example, a suitable phase gradient on the plane can be designed to ensure that the reflected ray in FIG. 1B follows the same path as the one in FIG. 1A. Hence, the observer will be lead to believe that he/she sees the original flat ground plane without any rotation or other modification. In other words, an observer will see the plane as flat, with no curvature, i.e., nothing "under the carpet".

Treating each point on the Gaussian cloaking surface locally as a flat plane, the entire cloaking surface can be parameterized by a local incident angle $\theta_L$ that is x-dependent and that is distinct from the global incident angle $\theta_G$ (see FIG. 1(C)). Assuming the wave is propagating in vacuum:

$$\sin(2\theta_G = \theta_L) - \sin(\theta_L) = \frac{1}{k_0}\frac{d\Phi(x)}{dx} \tag{3}$$

The phase gradient can then be expressed as a function of the cloaking surface shape z(x):

$$\frac{d\Phi(x)}{dx} = 2k_0\cos\theta_G\frac{dz(x)}{dx} \tag{4}$$

Finally, after integration the phase distribution ϕ(x) is given by:

$$\phi(x)=2k_0z(x)\cos\theta_G+\text{const} \tag{5}$$

where const is chosen from the known phase of the flat ground plane. This constant may be chosen to mimic the phase of the background that the metasurface needs to emulate. For example, the const is pi when the background is metallic.

From Eq. (5), it can be seen that in the limit of a flat scatterer, the phase distribution is identically constant as it should be. By providing the appropriate phase distribution, as dictated by Eq. 5, an arbitrary object can be hidden by a scattering metasurface by making the scattering metasurface look like a flat ground plane using a metasurface of class $C^1$, where such a surface is one described by a function whose first derivative is continuous. However, surfaces with discontinuous derivatives may be embedded under ones with continuous derivatives.

The construction of a device to take advantage of such principles is now described.

Referring to FIG. 2, a microwave metasurface 10 is shown. The microwave metasurface 10 is made of a number of dielectric elements such as cylinders 18 arranged on a substrate 16 for a particular frequency of incident electromagnetic waves, e.g., a frequency of 4.15 GHz (C-band). A unit cell 22 is shown in the inset, along with a coordinate system 12 and directions of E, H and k vectors 14. In one implementation, the layer 24 is the ground plane, the substrate 16 is a material such as Teflon(®), and the cylinder 18 is a dielectric material such as ceramic. The incident wave is polarized along the y-axis.

The elements described above are generally finite-sized subwavelength resonators whose modes can be used to provide the necessary phase. Elements which are dielectrics have certain advantages. For example, as noted above, the use of loss-free dielectric resonators can lead to applications in optics, whereas metals are lossy in these wavelength ranges. In addition, the systems described here can also be realized at higher frequencies by simply picking a proper class of sub-wavelength metasurface elements. A large phase-shift can be achieved by the disclosed technology using dielectric cylinders employing a metasurface with lower permittivities, e.g., such as Si or $TiO_2$. However, any nonabsorbing dielectric can be used, and the particular choice of dielectric or combination of dielectric is thus chosen based on the frequency range of interest. Such materials may be used to achieve near infrared/optical Mie resonances.

Table I below indicates exemplary materials and dimensions, though it will be understood given this disclosure that these values will vary depending on implementation and expected wavelength of incident wave, and thus where an exemplary range is given, values outside the range may also be employed for a given circumstance:

TABLE I

| Layer | Eligible Material or Class of Materials | Exemplary Ranges of Thicknesses t | Permittivity $\varepsilon_r$ | Loss Tangent tan δ | Diameter D |
|---|---|---|---|---|---|
| Cylinder | Dielectrics, e.g., ceramics | Varies as per required phase distribution as described above. | 2 to 2000, e.g., 41 +/− 0.75 | 0 to, e.g., $1.10^{-4}$ | 0.25 to 1 in, e.g., 0.58 in |
| Substrate | Low index and/or transparent materials, e.g., Teflon ® | 0.1 to 1.0 in, e.g., 0.23 in | An exemplary value is 2.1 | An exemplary value is $2.10^{-4}$ | N/A |

As noted in one implementation the phase distribution was discretized with 25 cylinders. Values in parentheses below are from this designed device. In this implementation, the elements 18 are cylinders having a circular cross-section and a fixed diameter (D=0.58 in) and the substrate 16 has a fixed thickness (t=0.23 in). The metasurface may also be periodic along y (in the figure only the periodicity along x is shown) with a sub-wavelength unit cell (w=1.16 in). The cylinders may be made of a high-permittivity ceramic ($\varepsilon_r$=41±0.75) with a low loss-tangent (tan δ=$1.10^{-4}$) and as noted may be embedded in a material having a low index or even a transparent material, e.g., a Teflon® substrate ($\varepsilon_r$=2.1) with an equally low loss-tangent (tan δ=$2.10^{-4}$). In this way, the metasurface is almost lossless.

In the implementation noted, the object is described by a Gaussian function as per Eq. 1. Its standard deviation a is in this implementation four times the unit cell width (σ=4.64 in), while its amplitude A is the same as the unit cell width (A=1.16 in). Finally, the global incident angle $\theta_G$ is chosen to be 45 degrees and the polarization of the incident wave is along the y axis (i.e., TE-polarized). The polarization of the reflected wave is the same as that of the incident wave in this implementation. It will be understood that variations may be seen of the above dimensions, and the same dependent on materials as well as on the wavelength ranges expected to be incident. In addition, the cylinders can be replaced with rectangular shaped solids, cubes, and the like.

Figure 3E:
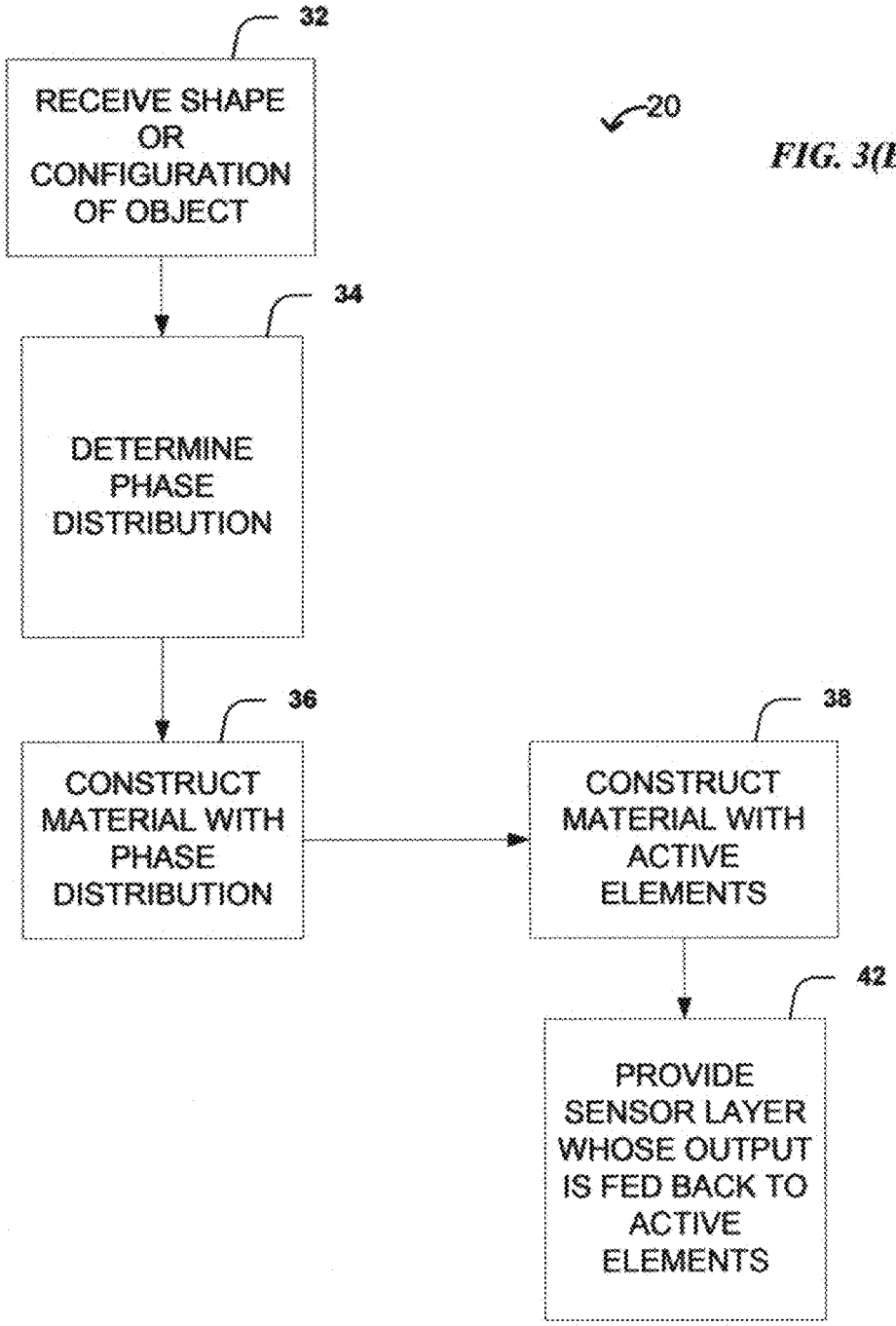
FIG. 3(E) is a flowchart illustrating a method of making a metasurface given an object shape to be cloaked.

To obtain a suitable phase gradient and phase distribution, a local variation in cylinder height was designed and configured, and in this implementation was the only geometrical parameter that was varied. As shown in FIG. 3A, from the scatterer geometry z(x), the local incident angle $\theta_L(x)$ may be computed, and then subsequently the phase distribution ϕ(x) from Eq. 5. From the phase distribution, the height of the cylinders can be derived as described below, by determining the phase shift for an incident angle as a function of cylinder height for a given unit cell element and a given frequency range of incident light.

As can be seen from Table II, to hide the object under the cloaking metasurface, the phase distribution covering the 0-to-2 π range is needed for different local incident angles.

Table II below illustrates samples of calculated z(x), $\theta_L(x)$, ϕ(x) and h(x) on the scatterer.

TABLE II

| Function\Index | 1 | 5 | 10 | 15 | 20 | 25 |
|---|---|---|---|---|---|---|
| z (in) | 0.01 | 0.16 | 0.88 | 1.02 | 0.25 | 0.01 |
| $\theta_L$ (deg) | 44.5 | 41.1 | 36.9 | 51.3 | 50.4 | 45.5 |
| ϕ (deg) | 180.0 | 154.2 | 26.7 | 0.4 | 137.5 | 180.0 |
| h (in) | 0.16 | 0.18 | 0.24 | 0.24 | 0.20 | 0.16 |

To determine if the required phase coverage was achievable for different local incident angles $\theta_L$, with the designed dielectric cylinders, the phase shift was simulated as a function of both local incident angle and cylinder height. Results are shown in FIG. 4, in which the phase shift was simulated by varying the height h and the local incident angle $\theta_L$ for a frequency of 4.15 GHz using the unit cell in FIG. 2 with a periodic boundary condition in x and y directions.

Figure 4:
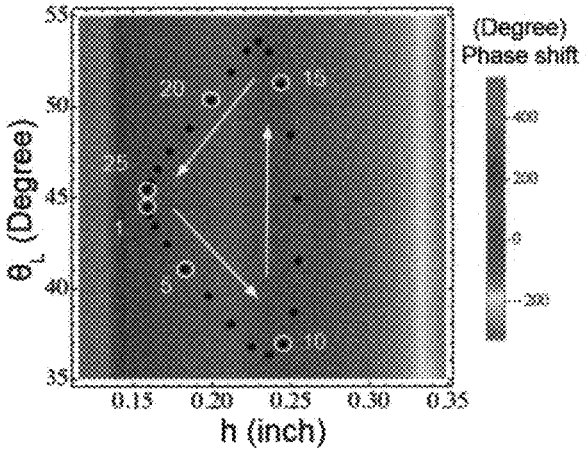
FIG. 4 shows a simulated phase shift with varying height h and local incident angle for a particular frequency of incident electromagnetic waves, e.g., 4.15 GHz, according to present principles. The dark points correspond to the different heights chosen for the 25 cylinders on the metasurface.

As can be seen from FIG. 4, the phase varies over more than 2π for the entire range of local incident angles required (35°≤θ≤55°), which is sufficient to reconstruct any needed phase. By interpolating the $\theta_L$–h diagram in FIG. 4, the height needed for each dielectric cylinder may be obtained, i.e., h(x). As noted in the designed implementation the phase distribution was discretized by varying the heights of 25 cylinders.

To compute the phase shift from a single metasurface element, it is assumed that its response can be approximated by that of an infinitely periodic array. In the case of the designed implementation, this is a particularly good approximation because the cylinders are made of a high permittivity material that concentrates the field and, as a result, the coupling between unit cells is weak enough to consider each unit cell as independent. Furthermore, since the phase gradients are small, neighboring cylinders are of comparable dimensions. Thus, the total field of the whole system can be treated as the superposition of the response of each unit cell as follows from Huygens principle, and carpet cloaking can be realized.

Using the above procedure, in a general method of designing a cloaking device, and referring to the flowchart 20 of FIG. 3B, in a method of making a suitable cloaking device, the shape or configuration of an object to be cloaked may be received in a first step (step 32), and then in a second step, a subsequent phase distribution can be computed to accomplish the desired cloaking (step 34), e.g., deriving a phase distribution suitable to cloak the object by making the object appear as a flat ground plane, e.g., by using an appropriately configured metasurface. The metasurface substrate and elements may then be constructed (step 36) according to the computed phase distribution. In some cases, as described above and below, the construction includes providing a number of elements such as dielectric cylinders appropriately sized and positioned on a substrate.

The system has also been modeled using computer simulations. In particular, the structure shown in FIG. 2 has been modeled using a commercial full-wave solver, CST Studio Suite 2014, and FIG. 5 shows the results of the simulation. FIG. 5(A) shows the reflection pattern (electric field) for the ground plane, FIG. 5(B) shows the reflection pattern for the Gaussian-shaped object itself, FIG. 5(C) shows the reflection pattern for the Gaussian-shaped object covered by the cloaking metasurface made of the dielectric cylinders, and FIG. 5(D) shows a metasurface using a more continuously varying refractive index satisfying the phase gradient. FIG. 5(C) is the simulation with the actual microstructured metasurface, i.e, an actual device. FIG. 5(D) is a mathematical approximation where the phase varies continuously.

In FIG. 5(B), the expected distortion was observed due to the scatterer, and in FIG. 5(C) its correction or cloaking is observed as provided by the metasurface. It is clear that the metasurface fixes the distortion considerably and the reflection pattern is that of a quasi-plane wave. Even with just about two cylinders per wavelength (approximately 4 inches), a very good reflection pattern was achieved, with significant cloaking observed. The result may be further improved by increasing the number of unit cells per wavelength as shown by the field pattern while using a more continuously varying refractive index (FIG. 5(D)). Of course, with a discrete system, the refractive index will be discreetly varied, but should be beneficial if the same still has a relatively continuous variation.

Figure 6:
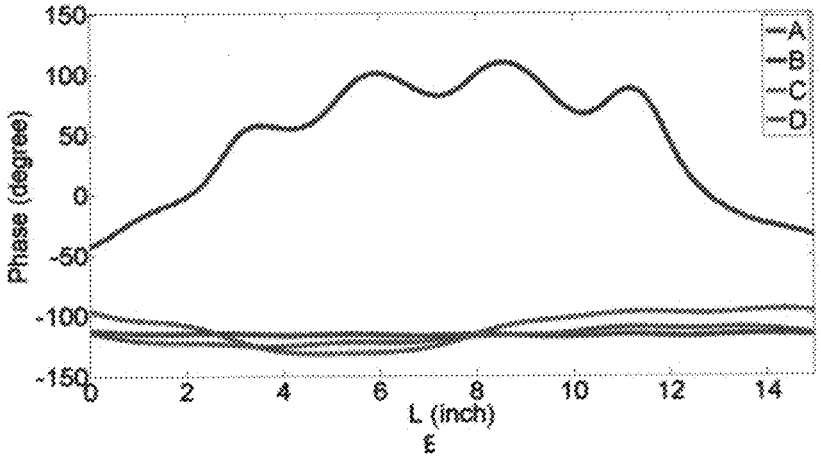
FIG. 6 illustrates electric field refraction patterns for the shapes of FIG. 5.

As a refinement of the above-noted technique, it is noted that additional distortions may be due to the fact that the metasurface corrects the local phase and cloaks primarily in the far field, as well as because use was made of a hypothetical plane wave of infinite extent filling all space in the simulations. In any actual device, the phase distribution needed on the metasurface will change with different global incident angles $\theta_G$ (the metasurface as described above was designed for $\theta_G$=45 degrees). To address this, an angular sensitivity study was performed. FIG. 6 is a phase plot along the equi-phase line L for each of the corresponding simulated structures in FIGS. 5(A)-5(D). Δ phase (degree) in FIG. 6 is the phase difference on the equi-phase line L between the phase reflected by the metasurface (designed for 45 degrees) and the phase expected from a flat ground plane for different global incident angles. Reasonable performances are obtained for $\theta_G$=45±6, i.e., for $\theta_G$ between 39 and 51 degrees, where the phase advance/delay is less than 3% of a period. To obtain a wider global incident angle range, reconfigurable metasurfaces may be designed by adding active elements. Such elements may be active particularly with regard to dimensionality of the unit cell elements, e.g., along the x, y, and z axes. For example, the height of the elements may be actively controlled with servomotors, piezoelectrics, and other means. In addition, the periodicity or distance between the unit cell elements may also vary and be controlled actively. An illustration of such active control is provided below in the context of FIG. 8.

Figure 7:
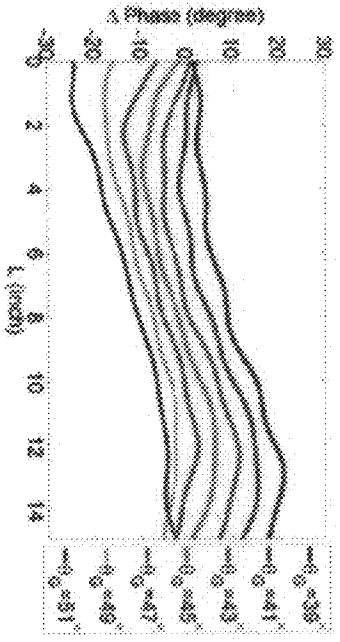
FIG. 7 illustrates a phase difference on the equi-phase line L between the phase reflected by the metasurf ace and the phase expected from a flat ground plane, for different global incident angles.

FIG. 7 illustrates a phase difference on the equi-phase line L between the phase reflected by the metasurface and the phase expected from a flat ground plane, for different global incident angles.

Further refinements can also be had. For these refinements, sensitivity analysis may be performed by computing the partial derivatives with respect to x, θ, and $k_0$. For example:

$$d\Phi \mid (x, \theta, k_0) = \frac{\partial \Phi}{\partial x} dx + \frac{\partial \Phi}{\partial \theta} d\theta + \frac{\partial \Phi}{\partial k_0} dk_0 \tag{6}$$

From Eqs. (5)-(6), several conclusions can be drawn.

First, the phase distribution sensitivity with respect to frequency is independent of frequency itself. Thus, there need be no special considerations for different frequency ranges. Second, the phase distribution sensitivity with respect to global incident angle is a maximum for grazing incidence ($\theta=\pi/2$). Thus, it is generally harder to cloak a scatterer for large angles of incidence. Finally, the phase distribution sensitivity with respect to position is, somewhat surprisingly, independent of position itself, for large slopes. All of this implies that a cloaking device can be configured to work for a large range of global incident angles and can be broadband if the phase distribution on the metasurface is linear with respect to frequency and cosine-like with respect to global incident angle.

For example, a square metal metasurface has an intrinsic cosine-like property. When the incident angle changes, the reflection phase will change as well. By designing suitable elements, e.g., particles, for each position, the metasurface can provide phase compensation with respect to the incident angle and can work for a broad range of angles Furthermore, by using active metasurf aces and adding an incident wave angle sensor layer which gives feedback to, and can cause changes in, the cloaking metasurface, the metasurface can operate at all angles.

In this case, and referring back to FIG. 3(E), the "construct material with phase distribution" step may be accomplished by constructing a material (step 38) with active metasurf ace elements (step 38). A sensor layer may then be provided whose output is fed back to the active elements (step 42).

Figure 8:
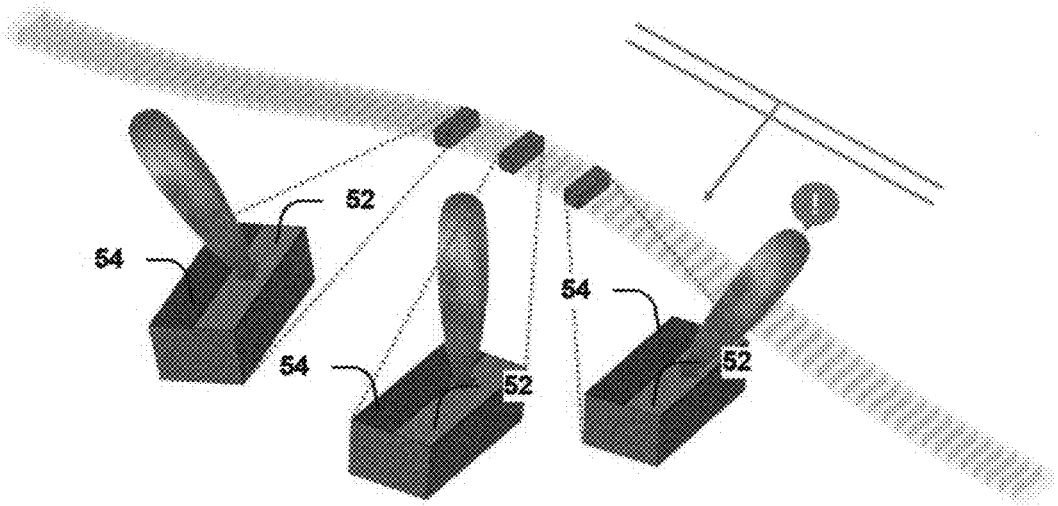
FIG. 8 illustrates a schematic depiction of operation at various angles.

For example, in FIG. 8, there are two elements in each block shown, a light gray one, an incident wave angle detector 52, provides the incident angle information to the dark gray one, which is a tunable cloaking metasurface 54, which generates phases according to the incident angle according to the systems and methods described above. The incident wave angle detector could be, for example, achieved by an antenna array. Each antenna may have a different orientation (radiation pattern) and the one that is fed by incoming waves will produce current. In this way, the incident angle can be detected and its information thus sent to the adjoining cloaking metasurface. As for the tunable cloaking metasurface, it can be realized by an active impedance metasurface. The impedance can be implemented using lumped elements (such as varactors, transistors, diodes) or by using phase change materials that can be actively controlled. This sensing and feedback mechanism can also further broaden the bandwidth by detecting frequency instead of detecting incident angle. This acts essentially as a radio that senses the incoming frequency and adapts the metasurface accordingly.

Figure 9:
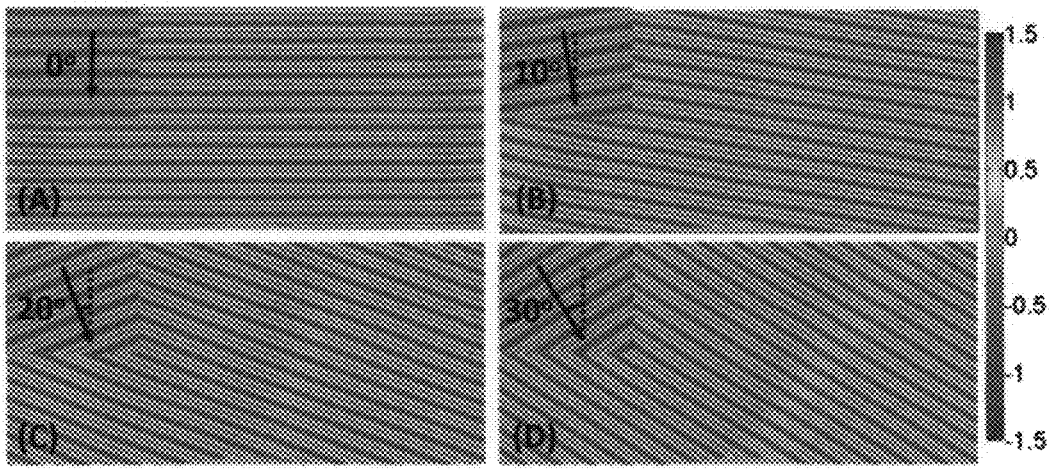
FIG. 9 illustrates the electric field reflection pattern for a Gaussian-shaped object at different incident angles: (A) 0°, (B) 10°, (C) 20°, and (D) 30°.

The passive metasurface can work at broad angles such as 0° to 60° from the normal, and can be broadband. For example, FIG. 9 illustrates the electric field reflection pattern for a Gaussian scatterer at different incident angles: (A) 0°, (B) 10°, (C) 20°, and (D) 30°. An active metasurface can work at all angles from 0° to 180° and be even broader band, using active elements.

Construction of the metasurface elements atop the substrate may be performed in a number of ways. For example, ceramic dielectrics may be fabricated from pressing powders, followed by grinding and slicing. Lithographic methods may also be used to process dielectrics or metals to form the resonators (elements).

What has been described is an extremely thin dielectric metasurface carpet cloak. The geometrical scheme presented is general and can be used for any surface of class C1 and for frequencies up to the visible. The proposed design flow gives a powerful recipe to design metasurface cloaks for a given geometry. A specific design has been presented and cloaking performance has been shown to be robust with respect to surface discretization. The observed wavefronts reflected from the proposed metasurface have been shown to be quasi-planar, with little to no distortion. With this design, observers will only see a flat ground plane, and the scatterer will be invisible and thus effectively cloaked. In addition, despite being designed for 45 degrees, accepting a phase advance/delay of 3% of the period results in an angular bandwidth of ±6 degrees.

Other applications will also be understood from this disclosure. Such applications may include hiding vehicles such as airplanes from radar or from unmanned areal vehicles (UAV). Systems and methods according to present principles can also be used in interior design to construct a virtual environment from thin engineered carpets. Applications can also be expected in art and jewelry protection/modification.

Figure 10:
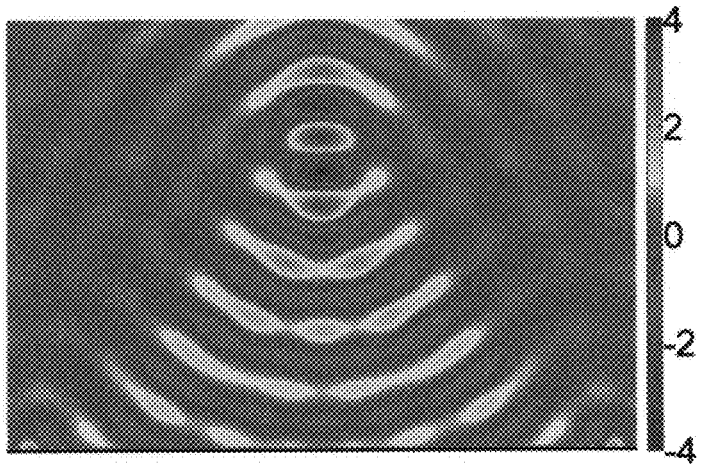
FIG. 10 illustrates an electric reflection pattern for a metasurface solar concentrator.

In addition to making a carpet cloaking device, the technology can also be employed in light focusing to make flat optics devices such as thin solar concentrators, quarter-wave plates, and spatial light. For example, in FIG. 10, the reflection pattern is shown for focusing with a flat, extra thin dielectric metasurf ace to make a solar concentrator. Such systems, because they can be designed to have a large incident angle acceptance, can minimize traction of the sun and provide minimum tracking position. The increased acceptance angle afforded by a planar design as well as the focusing capabilities of a dielectric metasurface over a wide angular range do not require a real-time tracking system to focus sun rays. The minimal tracking required by the metasurface thus decreases the cost of the system. Such systems can thus potentially replace parabolic troughs widely used in current systems to focus sunlight.

In addition, while the use of dielectrics has been detailed here, the invention is not limited to only such materials. In general, cloaking structures can be made with any resonator, e.g., dielectric or metallic. And while it is generally desired for the object covered with a cloaking metasurface to appear as a flat plane, a deviation from "flatness" may be acceptable and still provide sufficient cloaking. The extent to which variations can occur depends on the size of the elements chosen to implement the cloak. Typical variations can be, depending on implementation, a few degrees or a few fractions of degrees.

Making these surfaces reconfigurable, the systems and methods described here are expected to be applicable to flexible devices.

While the invention herein disclosed is capable of obtaining the objects and goals hereinbefore stated, it is to be understood that this disclosure is merely illustrative of the presently preferred embodiments of the invention and that no limitations are intended other than as described in the appended claims. Many other applications may also be envisioned given this disclosure.

The invention claimed is:

1. A cloaking device for an object configured to cloak the object from incident electromagnetic waves having a wavelength or range of wavelengths, comprising: a metasurface, the metasurface having a thickness less than the wavelength of the incident light, the metasurface configured to provide a phase distribution to the incident electromagnetic waves such that the incident electromagnetic waves are reflected in such a way that the metasurface appears substantially flat, wherein the metasurface is configured to cover the object to be cloaked, the object having a shape expressed by z(x), and wherein the phase distribution provided by the metasurface is according to an equation below, where $k_0$ is an angular frequency of the incident electromagnetic wave, $\theta_G$ is a global incident angle expected, and const is chosen from a known phase of a flat ground plane:

$$\phi(x)=2k_0z(x)\cos\theta_G+\text{const.}$$

2. The cloaking device of claim 1, wherein the metasurface is constructed such that a phase distribution results such that incident electromagnetic waves with frequencies between a microwave regime and a visible light regime are reflected in such a way that the metasurface appears flat.

3. The cloaking device of claim 2, wherein the metasurface is constructed such that incident microwaves are reflected in such a way that the metasurface appears flat.

4. The cloaking device of claim 1, wherein the phase distribution is such that the metasurface appears flat regardless of the shape of the object.

5. The cloaking device of claim 1, wherein the constant is selected to correlate to a phase of a background that the metasurface is emulating.

6. The cloaking device of claim 1, wherein the metasurface includes a plurality of elements, each comprising a dielectric disposed on a substrate.

7. The cloaking device of claim 6, wherein the elements are cylinders.

8. The cloaking device of claim 7, wherein a height of the cylinders is employed to provide the phase distribution.

9. The cloaking device of claim 6, wherein the dielectric is a ceramic.

10. The cloaking device of claim 9, wherein the ceramic is a high permittivity ceramic.

11. The cloaking device of claim 10, wherein the high permittivity ceramic has permittivity values ranging from about 10 to 1000.

12. The cloaking device of claim 9, wherein the ceramic has a low loss tangent.

13. The cloaking device of claim 12, wherein the ceramic has a low loss tangent ranging from about 0 to $10^{-2}$.

14. The cloaking device of claim 6, wherein the substrate comprises a low refractive index material or a transparent material.

15. The cloaking device of claim 14, wherein the substrate comprises polytetrafluoroethylene.

16. The cloaking device of claim 6, wherein the substrate has a low loss tangent.

17. The cloaking device of claim 1, wherein a refractive index of the metasurface is substantially continuously varied.

18. The cloaking device of claim 17, wherein the phase distribution is such that a refractive index of the metasurface is discreetly but substantially continuously varied.

19. The cloaking device of claim 1, wherein the phase distribution provided by the metasurface is linear with respect to frequency and cosine-like with respect to global incident angle.

20. The cloaking device of claim 1, wherein the metasurface is passive.

21. The cloaking device of claim 1, wherein the metasurface includes a plurality of active elements.

22. The cloaking device of claim 21, further comprising an incident wave angle sensor layer configured to provide a signal feedback to the plurality of active elements of the metasurface.

23. The cloaking device of claim 22, wherein the elements of the metasurface are configured to generate a phase distribution based on information about the incident wave angle received from the incident wave angle sensor layer.

24. The cloaking device of claim 1, wherein the appearance of being substantially flat means that variations in perceived flatness are no greater than a range of about a few fractions of a degree to a few degrees.

25. The cloaking device of claim 24, such that the range is between 0.5 and 5°.

26. A method of cloaking an object comprising covering an object with the device of claim 1.

27. A method for designing a cloaking device for an object, comprising:

a. receiving a shape of an object to be cloaked; and b. configuring a metasurface such that the metasurface provides a phase distribution configured such that electromagnetic rays incident on the metasurface are reflected in such a way that the metasurface appears flat, wherein the configuring includes configuring the phase distribution to be linear with respect to frequency and cosine-like with respect to global incident angle.

28. The cloaking device of claim 27, wherein the shape of the object to be cloaked is expressed by z(x), and where the phase distribution is configured to be according to the equation below, where $k_0$ is an angular frequency of the wave, $\theta_G$ is a global incident angle, and const is chosen from a known phase of a flat ground plane:

$$\phi(x)=2k_0z(x)\cos\theta_G+\text{const.}$$

29. A cloaking device for an object configured to cloak the object from incident electromagnetic waves having a wavelength or range of wavelengths, comprising: a metasurface, the metasurface having a thickness less than the wavelength of the incident light, the metasurface configured to provide a phase distribution to the incident electromagnetic waves such that the incident electromagnetic waves are reflected in such a way that the metasurface appears substantially flat, wherein the meta-surface includes a plurality of elements, each comprising a dielectric disposed on a substrate, wherein the elements are cylinders.

30. The cloaking device of claim 29, wherein a height of the cylinders is employed to provide the phase distribution.

31. The cloaking device of claim 29 wherein the dielectric is a ceramic.

32. A cloaking device for an object configured to cloak the object from incident electromagnetic waves having a wavelength or range of wavelengths, comprising: a metasurface, the metasurface having a thickness less than the wavelength of the incident light, the metasurface configured to provide a phase distribution to the incident electromagnetic waves such that the incident electromagnetic waves are reflected in such a way that the metasurface appears substantially flat, wherein the phase distribution provided by the metasurface is linear with respect to frequency and cosine-like with respect to global incident angle.

* * * * *